US011796245B2

(12) United States Patent
Jenkinson

(10) Patent No.: US 11,796,245 B2
(45) Date of Patent: Oct. 24, 2023

(54) SWING-UP STORAGE ASSEMBLY

(71) Applicant: Electrolux Home Products, Inc., Charlotte, NC (US)

(72) Inventor: Peter Jenkinson, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 17/548,920

(22) Filed: Dec. 13, 2021

(65) Prior Publication Data

US 2023/0184483 A1 Jun. 15, 2023

(51) Int. Cl.
*F25D 23/06* (2006.01)

(52) U.S. Cl.
CPC ..... *F25D 23/062* (2013.01)

(58) Field of Classification Search
CPC ..... F25D 23/062; F25D 23/067; F25D 25/00; F25D 25/025; F25D 2323/02
See application file for complete search history.

(56) References Cited

U.S. PATENT DOCUMENTS 7,628,461 B2 * 12/2009 Carden ..... F25D 25/04 312/402
7,731,805 B2 * 6/2010 Banta ..... A47L 15/506 211/41.9
7,794,027 B2 * 9/2010 Calabria ..... A47B 77/10 312/311
8,231,190 B2 * 7/2012 Ertz ..... F25D 25/025 312/402
8,303,053 B2 * 11/2012 Bond ..... A47B 46/005 312/319.2
9,377,238 B2 * 6/2016 Hall ..... F25D 25/025
9,510,679 B2 * 12/2016 Bhatt ..... A47B 88/90
9,895,046 B1 2/2018 Wilson et al.
10,045,682 B2 * 8/2018 Gerstner ..... A47L 15/506
10,729,306 B2 * 8/2020 Roos ..... A47L 15/50
10,852,004 B2 * 12/2020 Park ..... F24C 15/168
(Continued)

FOREIGN PATENT DOCUMENTS

DE 102012107993 3/2014
DE 102015104200 9/2016
(Continued)

OTHER PUBLICATIONS

International Search Report and Written Opinion for PCT/US2022/052096, dated Mar. 17, 2023, 17 pages.

*Primary Examiner* — Daniel J Rohrhoff
(74) *Attorney, Agent, or Firm* — Pearne & Gordon LLP

(57) ABSTRACT

A refrigerator appliance includes a refrigerator compartment with a bottom-hinged door that is operable to open and close the refrigerator compartment. In one example, the door is hingedly coupled to a bottom of the cabinet and configured to pivot between a closed state to restrict access, or an open state to permit access, to the freezer compartment. The refrigerator compartment includes a liner comprising opposing side walls. A swing-up storage assembly is pivotally and telescopically connected to the side walls and is configured to move between a lower retracted position and an upper extended position. The swing-up storage assembly includes a receptacle support body and a storage receptacle that is removably mounted to the receptacle support body.

14 Claims, 11 Drawing Sheets

(56) References Cited

U.S. PATENT DOCUMENTS

| | | | | |
|---|---|---|---|---|
| 10,932,568 | B2 * | 3/2021 | Subrahmanya | A47B 88/45 |
| 11,105,515 | B2 * | 8/2021 | Lee | F24C 15/168 |
| 11,561,040 | B2 * | 1/2023 | Choi | F25D 23/021 |
| 2004/0244825 | A1 * | 12/2004 | Ashton | A47L 15/506 134/92 |
| 2005/0206282 | A1 * | 9/2005 | Walburn | A47B 46/005 312/312 |
| 2007/0018548 | A1 * | 1/2007 | Ertz | A47B 88/70 312/402 |
| 2012/0074080 | A1 * | 3/2012 | Garcia | F24C 15/168 211/41.9 |
| 2014/0001425 | A1 * | 1/2014 | Falcon | A47B 51/00 254/133 R |
| 2015/0305493 | A1 | 10/2015 | Garcia et al. | |
| 2019/0099057 | A1 | 4/2019 | Scalf et al. | |
| 2019/0162466 | A1 * | 5/2019 | Yang | A47B 88/48 |
| 2020/0178757 | A1 | 6/2020 | Fawaz et al. | |
| 2021/0059499 | A1 | 3/2021 | Boyer et al. | |
| 2021/0212459 | A1 | 7/2021 | Bextermoller et al. | |
| 2021/0353054 | A1 | 11/2021 | Long | |
| 2022/0160205 | A1 | 5/2022 | Garcia et al. | |
| 2022/0160206 | A1 | 5/2022 | Garcia et al. | |

FOREIGN PATENT DOCUMENTS

| | | |
|---|---|---|
| DE | 102018111663 | 11/2019 |
| DE | 102018132802 | 11/2019 |
| DE | 102019107385 | 9/2020 |
| DE | 102019107389 | 9/2020 |
| EP | 1881282 | 1/2008 |
| EP | 3200670 | 8/2017 |
| KR | 20190104779 | 9/2019 |

* cited by examiner

SWING-UP STORAGE ASSEMBLY

FIELD OF THE INVENTION

This application relates generally to a novel refrigerator door and swing-up storage assembly for a refrigerator appliance, and more particularly to a novel refrigerator door and swing-up storage assembly that can be moved between a lower retracted position and an upper extended position.

BACKGROUND OF THE INVENTION

Conventional refrigeration appliances, such as domestic refrigerators, typically have both a fresh food compartment and a freezer compartment. The fresh food compartment is where food items such as fruits, vegetables, and beverages are stored and the freezer compartment is where food items that are to be kept in a frozen condition are stored. The refrigerators are provided with a refrigeration system that maintains the fresh food compartment at temperatures above 0° C., such as between 0.25° C. and 4.5° C. and the freezer compartment at temperatures below 0° C., such as between 0° C. and −20° C.

The arrangements of the fresh food and freezer compartments with respect to one another in such refrigerators vary. For example, in top-mount refrigerator appliances, the freezer compartment is located above the fresh food compartment. In bottom-mount refrigerator appliances, the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment may be accessed without exposing the other compartment to the ambient air.

Conventional bottom mount refrigerator appliances generally include a freezer compartment that is accessible via a pull-out drawer. Such pull-out drawers typically include an upper tier with an extendable bin or basket and a bottom tier with a freezer basket coupled to a rear surface of the pull-out drawer. In these appliances, the freezer basket is configured to slide out with the pull-out drawer when the drawer is pulled forward by a user. Retrieving food items from the freezer basket requires a user to lean over which is ergonomically unsuitable for many users, for example, for users experiencing chronic back pain. Moreover, viewing the entire extent of the freezer basket requires many users to lean over to sort through the inner contents of the basket. It is desirable to have a novel freezer door which utilizes a bottom hinge to open downwards. It is also desirable to have a storage receptacle for a bottom-mount refrigerator that can be pulled forward and raised upward thereby making the freezer basket more accessible.

BRIEF SUMMARY OF THE INVENTION

The following presents a simplified summary of the disclosure in order to provide a basic understanding of some example aspects described in the detailed description. This summary is not an extensive overview. Moreover, this summary is not intended to identify critical elements of the disclosure nor delineate the scope of the disclosure. The sole purpose of the summary is to present some concepts in simplified form as a prelude to the more detailed description that is presented later.

In accordance with one aspect, there is provided a refrigerator appliance including a cabinet defining a storage compartment therein. The storage compartment includes opposing side walls, a rear wall, a bottom wall, and a top wall that collectively define a front access opening. A door is hingedly connected to a lower portion of the cabinet and is configured to restrict or permit access to the storage compartment through the front access opening. The refrigerator appliance also includes a freezer storage assembly with a receptacle support body and a receptacle removably mounted to the receptacle support body. The receptacle defines a storage space for food items. The receptacle support body is pivotally and telescopically mounted to the side walls of the storage compartment and includes a handle protruding upwardly therefrom. The handle is operable to move the receptacle support body between a lower retracted position and an upper extended position.

In accordance with another aspect, there is provided a swing-up storage assembly for a storage compartment of a refrigerator appliance. The swing-up storage assembly includes a support body, two pairs of telescoping assemblies, and a removable storage accessory. The support body includes a front wall, a rear wall, and opposing side walls that collectively define an internal space. An upwardly protruding handle is formed about the front wall of the support body and is operable to move the support body between a lower retracted position and an upper extended position. Each pair of telescoping assemblies is configured to pivotally and telescopically connect a respective side wall of the support body to a corresponding side wall of the storage compartment. The removable storage accessing is shaped and dimensioned to be removably mounted in the internal space of the support body.

In accordance with yet another aspect, a refrigerator appliance includes a cabinet defining a freezer compartment therein. The freezer compartment includes opposing side walls, a rear wall, a bottom wall, and a top wall that collectively define a front access opening. A door is hingedly coupled to a bottom of the cabinet and is configured to pivot between a closed state to restrict access, or an open state to permit access, to the freezer compartment through the front access opening. The refrigerator appliance also includes an upper rack defining a first storage space for food items and a lower rack defining a second storage space for food items. The upper rack is slidably supported by the freezer compartment and is configured to be extended forwardly to facilitate access to the first storage space. The lower rack is supported by the bottom wall of the freezer compartment when the lower rack is in a retracted state. The lower rack is configured to be extended forwardly onto a rear surface of the door to facilitate access to the lower rack when the door is pivoted to the open state.

It is to be understood that both the foregoing general description and the following detailed description present embodiments of the present disclosure, and are intended to provide an overview or framework for understanding the nature and character of the embodiments as they are described and claimed. The accompanying drawings are included to provide a further understanding of the embodiments, and are incorporated into and constitute a part of this specification. The drawings illustrate various embodiments of the disclosure and together with the description serve to explain the principles and operations thereof.

BRIEF DESCRIPTION OF THE DRAWINGS

These and other features, aspects and advantages of the present disclosure can be further understood when read with reference to the accompanying drawings.

DESCRIPTION OF EXAMPLE EMBODIMENTS

Figure 1:
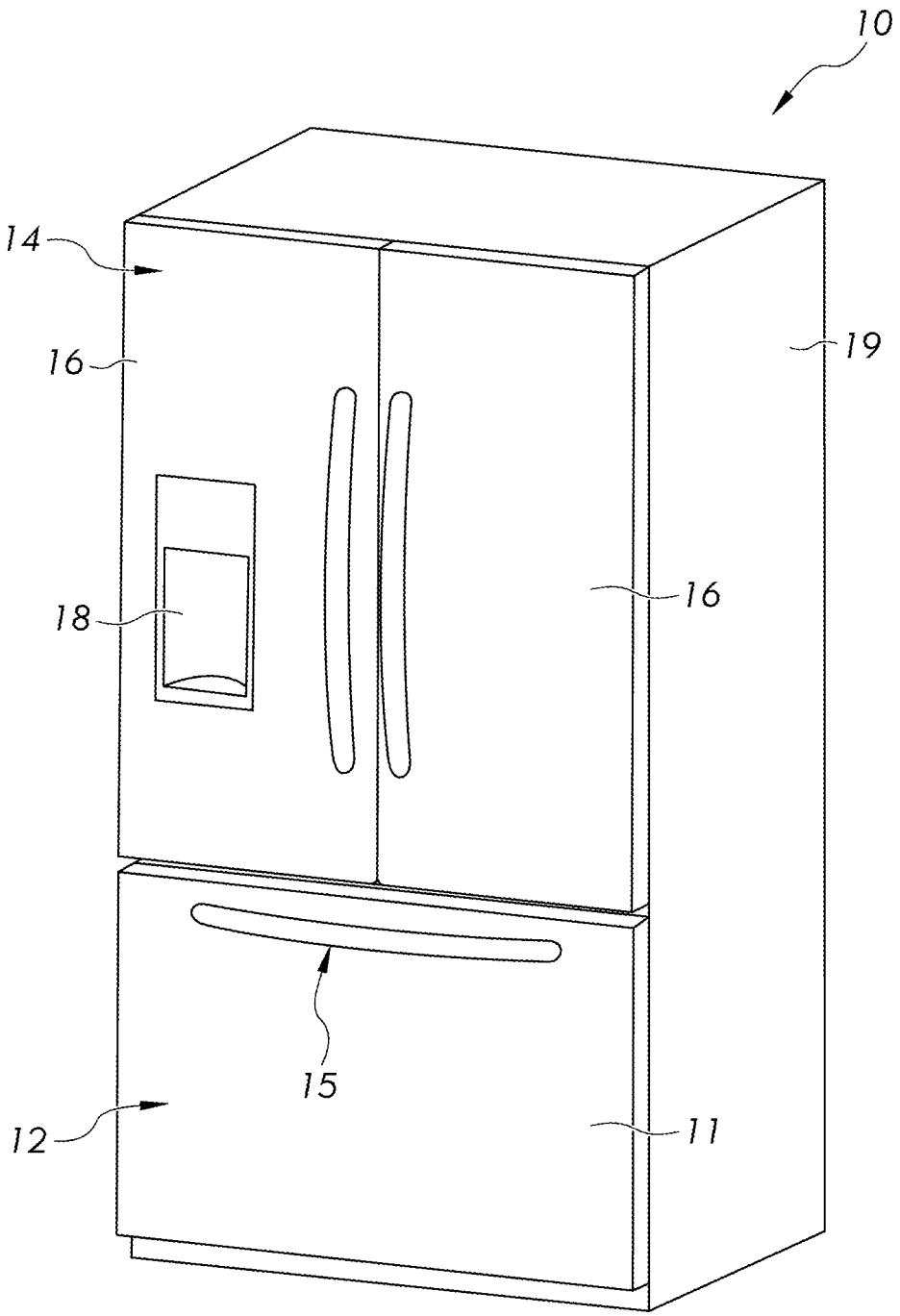
FIG. 1 is a front perspective view of a household French Door Bottom Mount refrigerator wherein doors of the refrigerator are in a closed position.

Apparatus will now be described more fully hereinafter with reference to the accompanying drawings in which embodiments of the disclosure are shown. Whenever possible, the same reference numerals are used throughout the drawings to refer to the same or like parts. However, this disclosure may be embodied in many different forms and should not be construed as limited to the embodiments set forth herein.

Referring now to the drawings, FIG. 1 shows a refrigeration appliance in the form of a domestic refrigerator, indicated generally at 10. Although the detailed description that follows concerns a domestic refrigerator 10, the invention can be embodied by refrigeration appliances other than with a domestic refrigerator 10. Further, an embodiment is described in detail below, and shown in the figures as a bottom-mount configuration of a refrigerator 10, including a fresh food storage compartment 14 disposed vertically above a lower freezer storage compartment 12. However, the refrigerator 10 can have any desired configuration including at least one of a fresh food storage compartment 14 and/or a freezer storage compartment 12.

One or more doors 16 shown in FIG. 1 are pivotally coupled to a cabinet 19 of the refrigerator 10 to restrict and grant access to the fresh food storage compartment 14. The door 16 can include a single door that spans the entire lateral distance across the entrance to the fresh food storage compartment 14, or can include a pair of French-type doors 16 as shown in FIG. 1 that collectively span the entire lateral distance of the entrance to the fresh food storage compartment 14 to enclose the fresh food storage compartment 14. For the latter configuration, a center flip mullion 21 (FIG. 2) is pivotally coupled to at least one of the doors 16 to establish a surface against which a seal provided to the other one of the doors 16 can seal the entrance to the fresh food storage compartment 14 at a location between opposing side surfaces 17 (FIG. 2) of the doors 16. The mullion 21 can be pivotally coupled to the door 16 to pivot between a first orientation that is substantially parallel to a planar surface of the door 16 when the door 16 is closed, and a different orientation when the door 16 is opened. The externally-exposed surface of the center mullion 21 is substantially parallel to the door 16 when the center mullion 21 is in the first orientation, and forms an angle other than parallel relative to the door 16 when the center mullion 21 is in the second orientation. The seal and the externally-exposed surface of the mullion 21 cooperate approximately midway between the lateral sides of the fresh food storage compartment 14.

A dispenser 18 (FIG. 1) for dispensing at least ice pieces, and optionally water, can be provided on an exterior of one of the doors 16 that restricts access to the fresh food storage compartment 14. The dispenser 18 includes an actuator (e.g., lever, switch, proximity sensor, etc.) to cause frozen ice pieces to be dispensed from an ice bin 34 (FIG. 2) of an ice maker 30 disposed within the fresh food storage compartment 14. Ice pieces from the ice bin 34 can exit the ice bin 34 through an aperture 32 and be delivered to the dispenser 18 via an ice chute 22 (FIG. 2), which extends at least partially through the door 16 between the dispenser 18 and the ice bin 34.

In alternative embodiments, the ice maker is located within the freezer compartment. In this configuration, although still disposed within the freezer compartment, at least the ice maker (and possible an ice bin) is mounted to an interior surface of the freezer door. It is contemplated that the ice mold and ice bin can be separate elements, in which one remains within the freezer compartment and the other is on the freezer door.

The freezer storage compartment 12 is used to freeze and/or maintain articles of food stored in the freezer storage compartment 12 in a frozen condition. For this purpose, the freezer storage compartment 12 is in thermal communication with a freezer evaporator (not shown) and associated blower fan (not shown) that removes thermal energy from the freezer storage compartment 12 to maintain the temperature therein at a temperature of 0° C. or less during operation of the refrigerator 10, preferably between 0° C. and −50° C., more preferably between 0° C. and −30° C. and even more preferably between 0° C. and −20° C.

Figure 2:
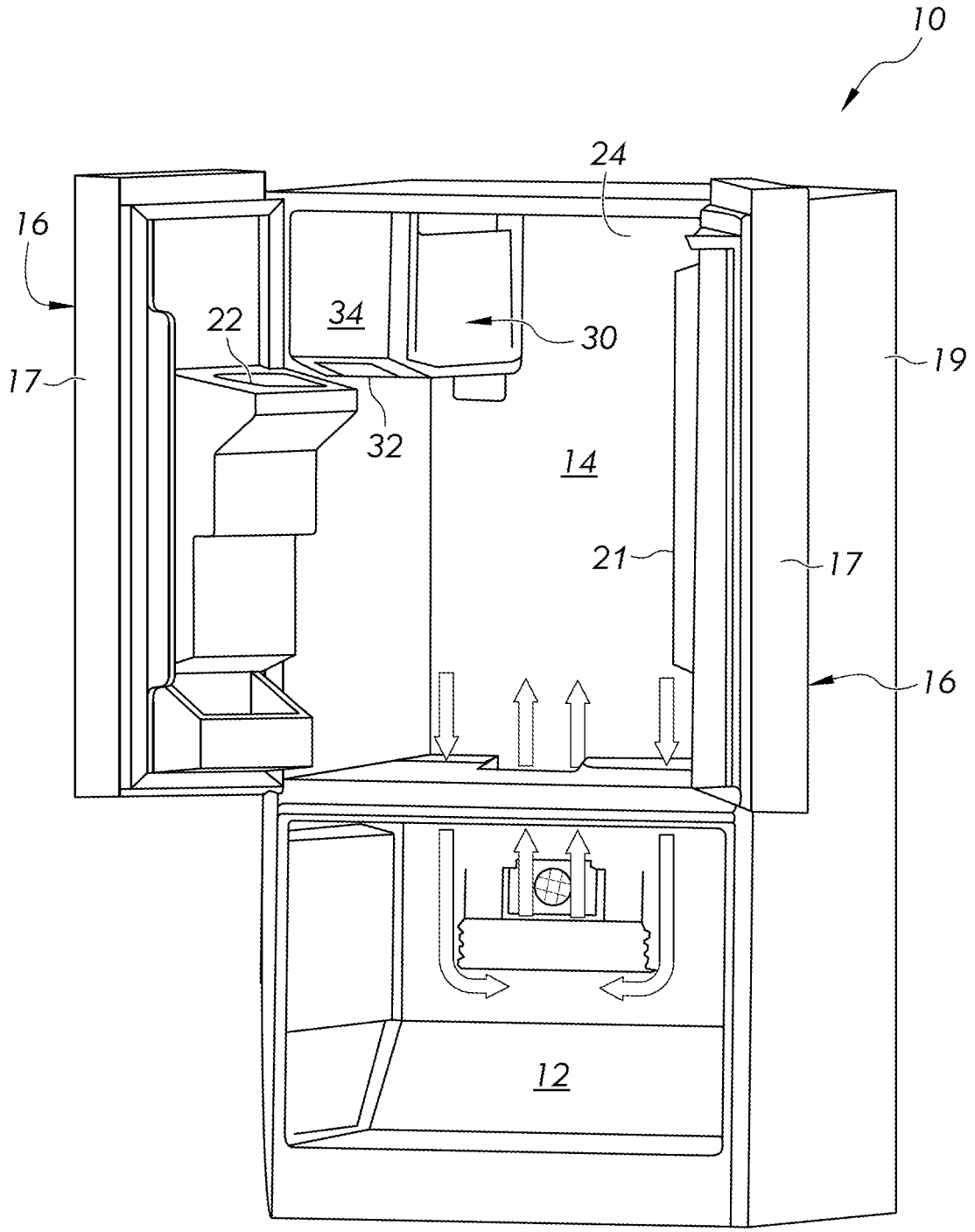
FIG. 2 is a front perspective view of the refrigerator of FIG. 1 showing the doors in an opened position and an interior of a fresh food compartment as well as an interior of a freezer compartment.

Referring to FIGS. 1 and 2, the freezer storage compartment 12 is arranged vertically beneath the fresh food storage compartment 14. The freezer storage compartment 12 may include a freezer door 11 with a handle 15 that is operable to open the freezer door 11 when it is desired to access food items stored in the freezer storage compartment 12.

The refrigerator 10 includes an interior liner 24 (FIG. 2) that defines the fresh food storage compartment 14. The fresh food storage compartment 14 is located in the upper portion of the refrigerator 10 in this example and serves to minimize spoiling of articles of food stored therein. The fresh food storage compartment 14 accomplishes this by maintaining the temperature in the fresh food storage compartment 14 at a cool temperature that is typically above 0° C., so as not to freeze the articles of food in the fresh food storage compartment 14. It is contemplated that the cool temperature preferably is between 0° C. and 10° C., more preferably between 0° C. and 5° C. and even more preferably between 0.25° C. and 4.5° C. According to some embodiments, cool air from which thermal energy has been removed by the freezer evaporator can also be blown into the fresh food storage compartment 14 to maintain the temperature therein greater than 0° C. preferably between 0° C. and 10° C., more preferably between 0° C. and 5° C. and even more preferably between 0.25° C. and 4.5° C. For alternate embodiments, a separate fresh food evaporator can optionally be dedicated to separately maintaining the temperature within the fresh food storage compartment 14 independent of the freezer storage compartment 12. According to an embodiment, the temperature in the fresh food storage compartment 14 can be maintained at a cool temperature within a close tolerance of a range between 0° C. and 4.5° C., including any subranges and any individual temperatures falling with that range. For example, other embodiments can optionally maintain the cool temperature within the fresh food storage compartment 14 within a reasonably close tolerance of a temperature between 0.25° C. and 4° C.

Figure 3:
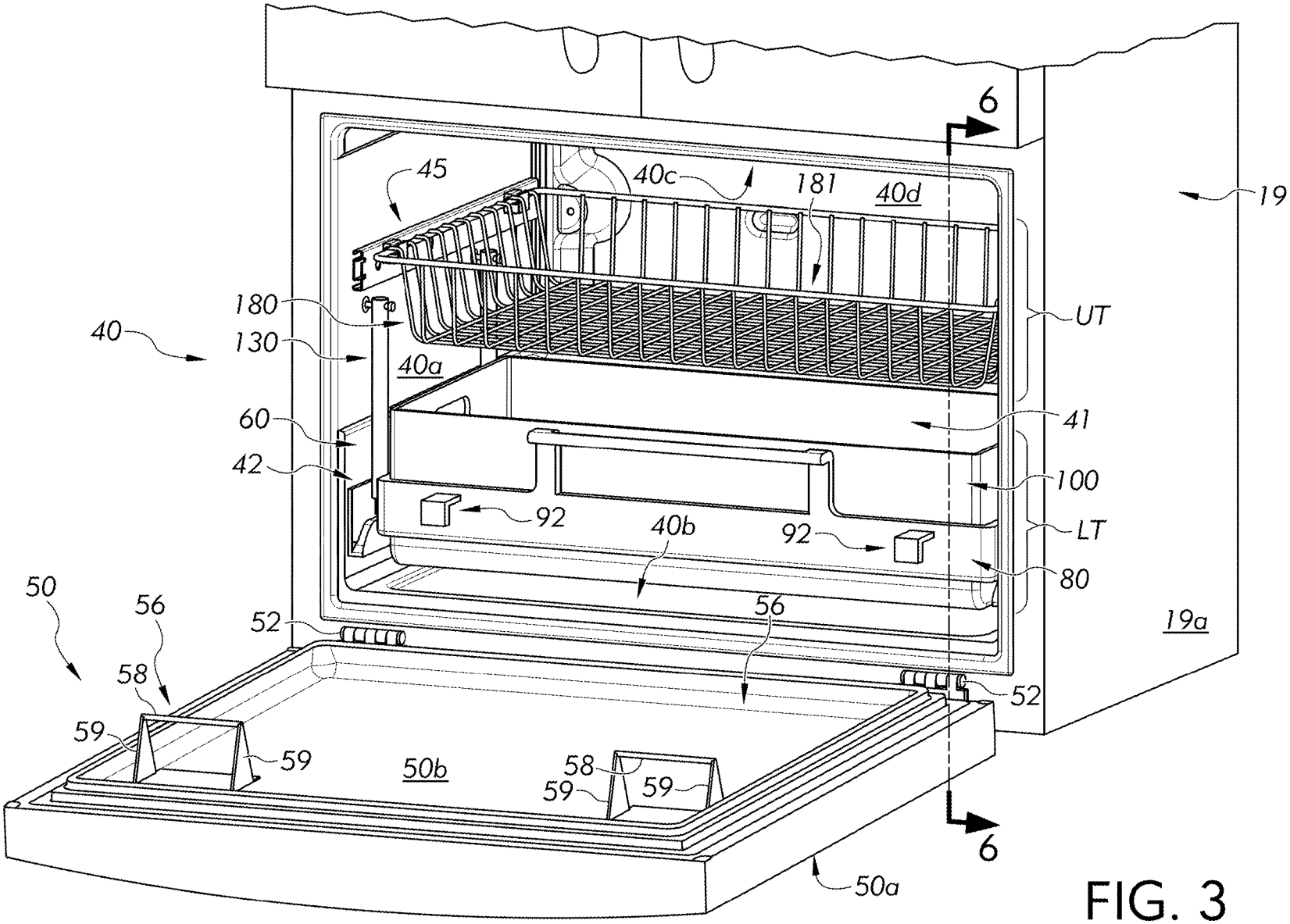
FIG. 3 is a partial, front perspective view of a freezer compartment according to another embodiment including a bottom-hinged freezer door and an example swing-up storage assembly as disclosed herein.

Turning now to FIG. 3, a freezer compartment 40 for a bottom-mount refrigerator is shown with a bottom-hinged freezer door 50, an extendable basket or rack 180, and a swing-up storage assembly 60 as described herein. The freezer compartment 40 is defined by an interior liner comprising opposing side walls 40*a*, a bottom wall 40*b*, a top wall 40*c*, and a rear wall 40*d* that together define a front access opening 41. In the illustrated embodiment, the freezer compartment is divided into an upper tier (UT) that accommodates the rack 180 and a lower tier (LT) that accommodates the swing-up storage assembly 60.

The freezer door 50 is a substantially rectangular-shaped body that is dimensioned to permit or restrict access to the front access opening 41. The door 50 is pivotally coupled to a bottom portion of the cabinet 19 via a pair of hinges 52 such that the door 50 may rotate between an open position (as shown) to grant access to the freezer compartment 40 and a closed position whereby the door 50 sealingly engages the cabinet 19 to prevent cold air from escaping the freezer compartment 40. It is contemplated that a magnetic seal or gasket (not shown) may be disposed about a periphery of the front access opening 41 and/or about a periphery of the door 50 to maintain the door 50 closed, e.g., to inhibit cold air from escaping the freezer compartment 40. It is also contemplated that the hinges 52 may be spring-loaded to urge the door closed to thereby maintain a sealing engagement with a periphery of the front access opening 41. It is also contemplated that springs or another form of a damper (e.g., gas struts, pneumatic door closer) may be utilized to prevent the door 50 from rapidly swinging open when a user attempts to open the door 50.

Figure 9:
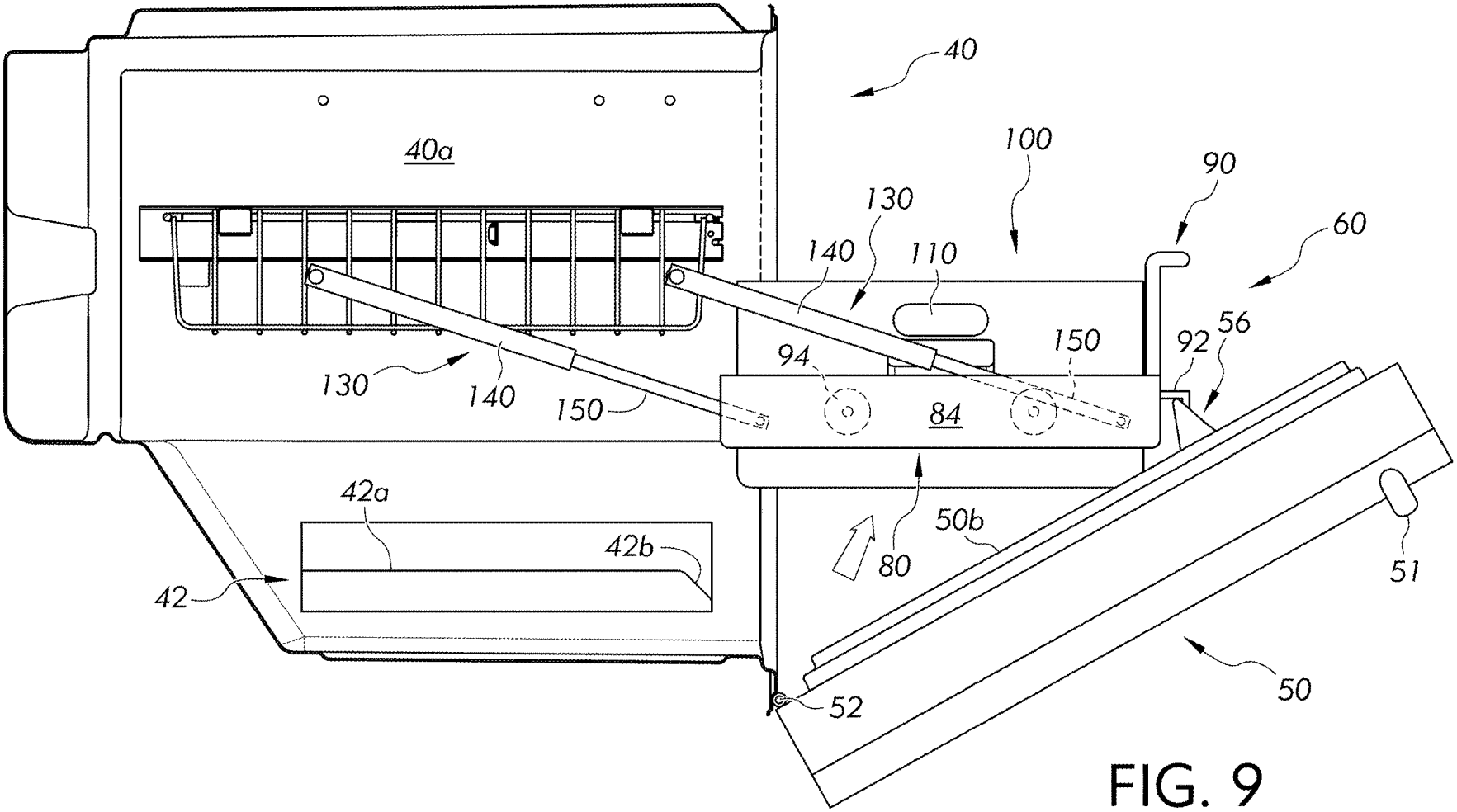
FIG. 9 is a side view of the freezer storage compartment taken in the direction of line 6-6 of FIG. 3 in a state wherein the swing-up storage assembly is in an upper extended position.

The door 50 includes a front surface 50*a* and a rear surface 50*b*. A pair of catches 56 are affixed to the rear surface 50*b* of the door 50 and are positioned to removably engage a pair of hooks 92 disposed on a front of the swing-up storage assembly 60, respectively, to maintain the swing-up storage assembly 60 in an upper extended position (FIG. 9). In particular, each catch 56 may include a cross bar or keeper 58 spaced apart from the rear surface 50*b* of the door 50 via a pair of support arms 59 affixed to the rear surface 50*b* of the door 50. An outwardly protruding handle 51 (FIG. 7) is disposed on the front surface 50*a* of the door 50 and is operable to pull the door 50 open, i.e., to cause the door 50 to pivot forward upon the hinges 52. Yet, in other embodiments, it is contemplated that a pocket handle (not shown) may be formed into a front surface 50*a* of the door 50.

Still referring to FIG. 3, the rack 180 is slidably supported by the freezer compartment 40 and is configured to accommodate food items therein. In the illustrated example, the rack 180 comprises a rectangular-shaped wire basket that defines a storage space 181 for food items. In other embodiments, it is contemplated that the rack 180 may embody other suitable structures for storing food items therein, e.g., a storage receptacle or an enclosed container defined by a plurality of solid walls. The rack 180 is slidably supported by the freezer compartment 40 via a pair of linearly extendable slides 45 respectively affixed to the side walls 40*a* of the freezer compartment 40 (one being hidden by the outer case 19*a*). The slides 45 enable the rack 180 to be withdrawn forward when a user desires to retrieve food items from the rack 180. In some examples, it is contemplated that the slides 45 may utilize ball-bearings or similar structure for providing a reduced friction interface between the rack 180 and the freezer compartment 40, e.g., to enable the rack 180 to be more easily withdrawn by a user.

The swing-up storage assembly 60 includes a receptacle support body 80 and a storage receptacle 100 that is removably mounted to the receptacle support body 80, as discussed in detail below. In general, the swing-up storage assembly 60 comprises structure that makes the storage receptacle 100 located in the lower tier LT of the freezer compartment 40 more accessible for a user, as described in detail below. Although the examples herein illustrate a swing-up storage assembly 60 for use in conjunction with a bottom-hinged door for a freezer compartment, it should be understood that the various inventions described herein may also be adapted for use with a hinged door for a fresh food compartment.

Figure 4:
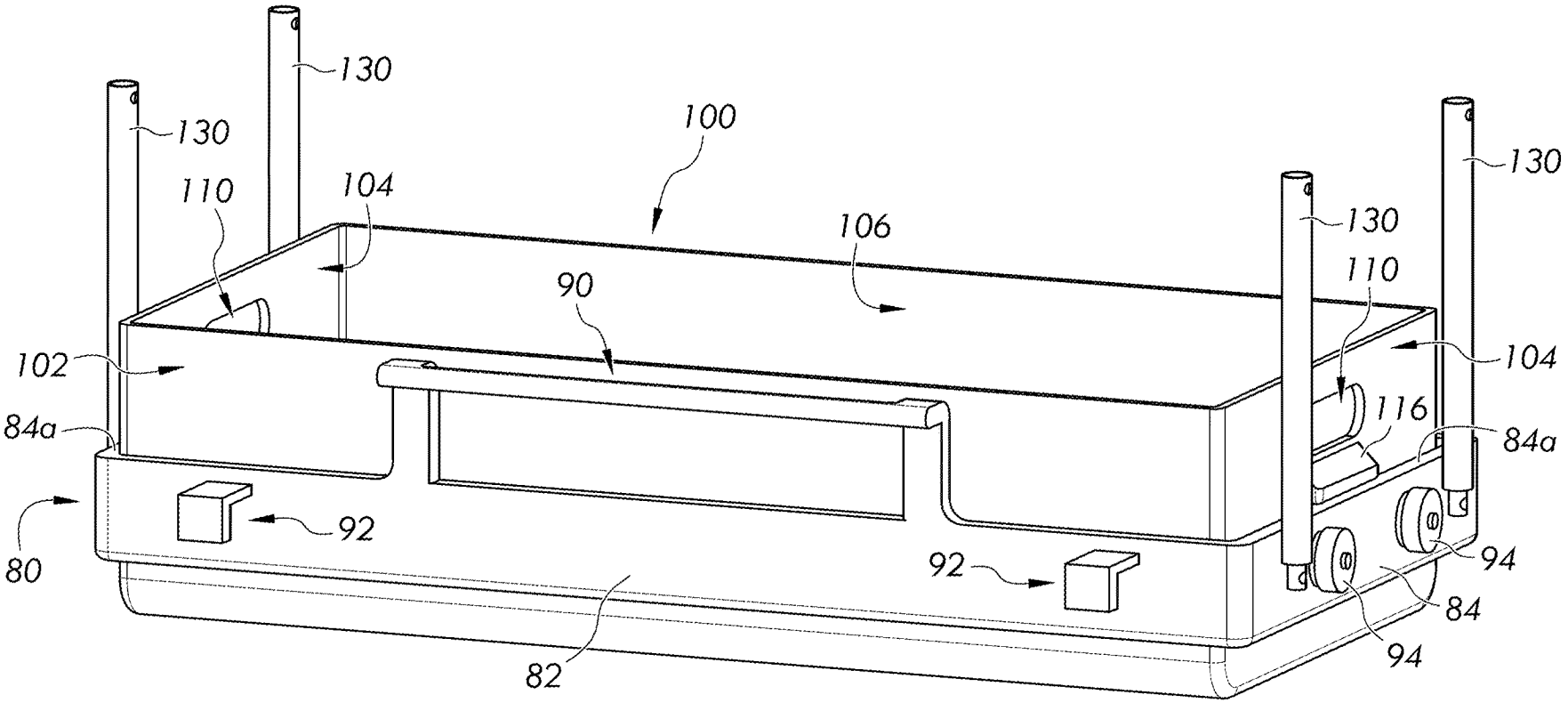
FIG. 4 is an enlarged, perspective view of the swing-up storage assembly of FIG. 3.
Figure 5:
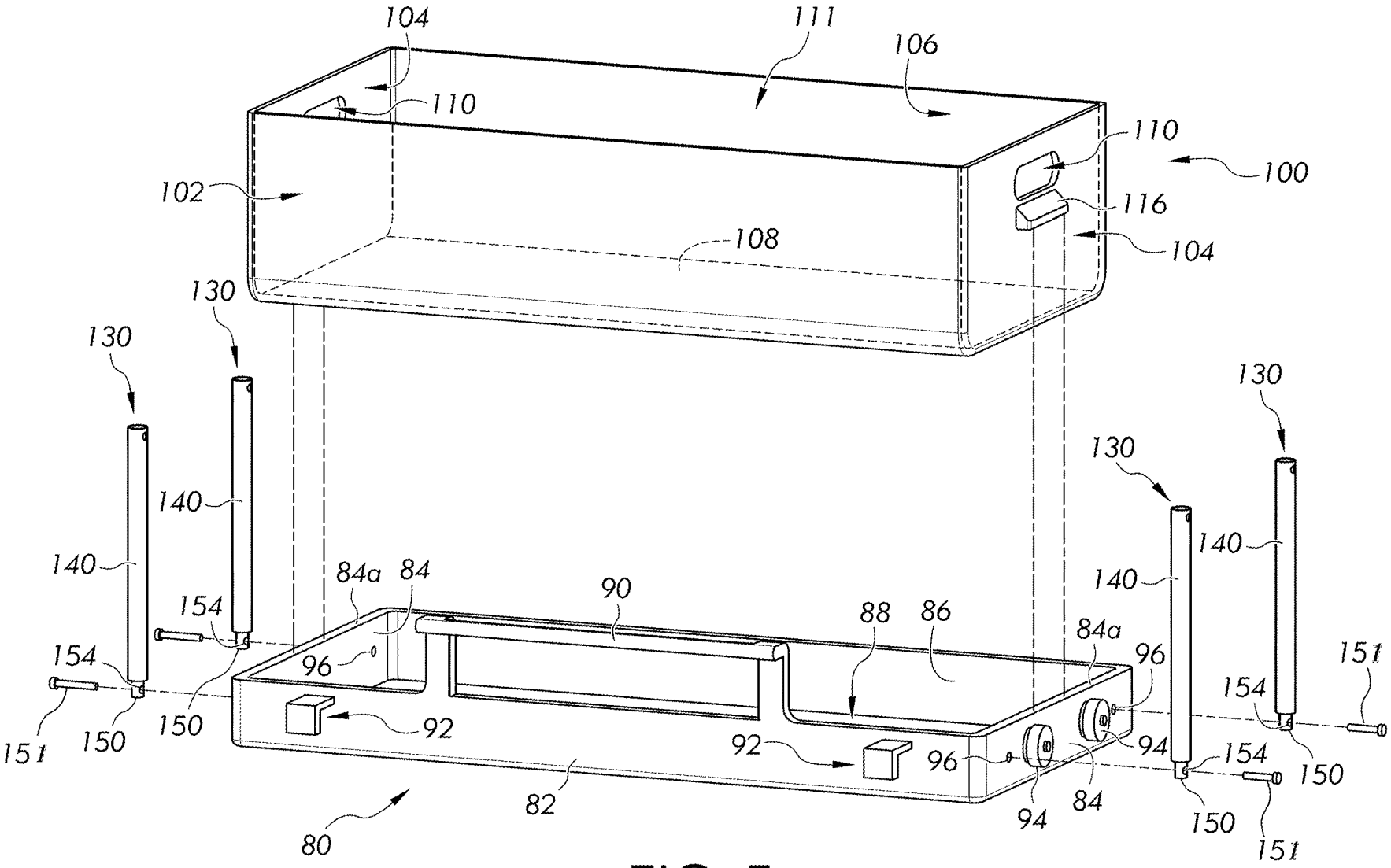
FIG. 5 is an exploded, perspective view of the swing-up storage assembly of FIG. 3.

Referring to FIGS. 4 and 5, the receptacle support body 80 is a substantially rectangular-shaped structure including a front wall 82, a rear wall 86 (FIG. 5), and opposing side walls 84 that collectively define an internal space or opening 88 (FIG. 5) for partially receiving therethrough the storage receptacle 100. In general, the receptacle support body 80 is used to removably support the storage receptacle 100 and is preferably made of a metal material of suitable strength for accomplishing this purpose. An upwardly protruding handle 90 is formed about an upper edge of the front wall 82 and is operable to move (e.g., withdraw and raise or retract and lower) the storage receptacle 100 between a lower retracted position (FIG. 7) and an upper extended position (FIG. 9). Providing a handle 90 that protrudes upwardly from the receptacle support body 80 is a feature that improves the ergonomic usability of the swing-up storage assembly 60, especially for those users that would otherwise have trouble (e.g., due to chronic back pain) reaching down to grasp the freezer storage receptacle when it is desired to retrieve food items stored therein.

Still referring to FIGS. 4 and 5, a pair of L-shaped hooks 92 are formed on the front wall 82 of the receptacle support body 80 and are positioned to removably engage the catches 56 (FIG. 3) formed on the rear surface 50*b* of the freezer door 50, respectively, to maintain the receptacle support body 80 in a raised or upper extended position (FIG. 9). Yet, in other embodiments, it is contemplated that the front of the receptacle support body 80 may include catches (not shown) that are configured engage hooks (not shown) formed on a rear surface of the door.

Each side wall 84 of the receptacle support body 80 may include a pair of rollers 94 attached thereto that are configured to roll on rails 42 (FIG. 6) attached to the side walls 40*a* of the freezer compartment 40, respectively. The rollers 94 are configured to facilitate the extension or retraction of the receptacle support body 80 (and therefore the storage receptacle 100) relative to the freezer compartment 40, as described in detail below.

As shown in FIG. 5, each side wall 84 of the receptacle support body 80 defines openings 96 for receiving removable fasteners 151 therethrough, respectively, that are utilized to pivotally connect respective ends of a pair of telescoping assemblies 130 to the receptacle support body 80. In various non-limiting examples, the removable fasteners may embody pins or shoulder screws that enable the respective ends of the telescoping assemblies 130 to freely rotate relative to the receptacle support body 80.

An upper edge 84*a* of each side wall 84 of the receptacle support body 80 is configured to engage a protrusion 116 formed on a respective side of the storage receptacle 100. In this manner, each edge 84*a* is configured to receive thereon the respective protrusion 116 to vertically support the storage receptacle 100 in the freezer compartment 40, i.e., to thereby removably mount the storage receptacle 100 to the receptacle support body 80. Yet, it is contemplated that in other embodiments the receptacle support body 80 may define a bottom wall (not shown) rather than an opening for removably nesting or seating the storage receptacle 100 thereon, for example, in such embodiments wherein the storage receptacle is sized and dimensioned to rest on a bottom wall of the receptacle support body. It is also contemplated that the receptacle support body 80 may be shaped and dimensioned to cooperate with a variety of different accessory items (e.g., freezer basket, ice bucket, etc.) that may be removably mounted thereto. It is also contemplated that the receptacle support body 80 may embody a carrier drawer including mating features that are designed to cooperate with corresponding mating features formed on the storage receptacle, for example, the mating features (e.g., contoured recesses and self-locating guides) disclosed in U.S. application Ser. No. 17/380,242 (assigned to the applicant) which is incorporated by reference for all that it contains. It is also contemplated that the receptacle support body 80 may be reconfigured to accommodate more than one accessory item, for example a freezer basket and an ice bucket (not shown).

With reference to FIGS. 4 and 5, the storage receptacle 100 is a substantially rectangular-shaped body that is configured to be removably mounted to the receptacle support body 80. In the illustrated example, the storage receptacle 100 includes a front wall 102, a rear wall 106, a bottom wall 108 (FIG. 5), and opposing side walls 104 that collectively define a storage space 111 (FIG. 5) for storing various food items therein. Yet, in other embodiments it is contemplated that the storage receptacle 100 may embody another form of an accessory item, for example, a removable ice bucket or a wire basket. In this manner, it is contemplated that a wide variety of storage accessories may be removably mounted to the receptacle support body 80.

In the illustrated embodiment, an opening 110 is formed in each side wall 104 of the storage receptacle 100 for defining a corresponding handle that is operable to lift and remove the storage receptacle 100 from the receptacle support body 80. A protrusion 116 is formed on each side wall 104 of the storage receptacle 100 and is configured to engage or rest against the respective upper edge 84*a* of the receptacle support body 80, as discussed in detail above.

Figure 6:
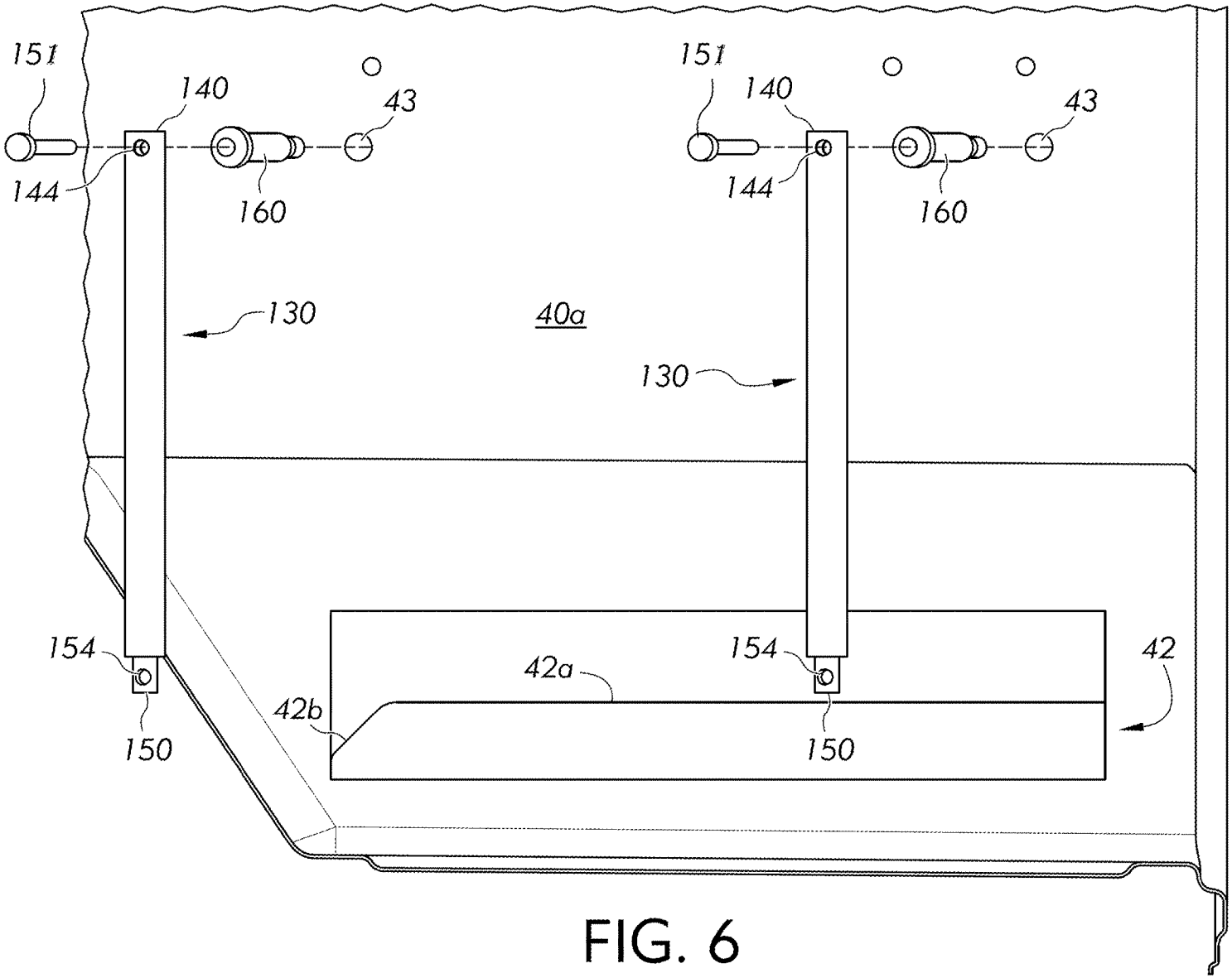
FIG. 6 is a partially exploded, side view of a freezer compartment wall of FIG. 3.

Referring to FIGS. 5 and 6, a pair of telescoping assemblies 130 are provided to pivotally and telescopically connect each side of the receptacle support body 80 to a respective side wall 40*a* (FIG. 6) of the freezer compartment 40. Each telescoping assembly 130 includes a first or outer rod 140 and a second or inner rod 150 that telescopically cooperate to enable the swing-up storage assembly 60 to be moved between a lower retracted position (FIG. 7) and an upper extended position (FIG. 9). It is contemplated that the telescoping assemblies 130 may embody gas struts or may include tension springs that are configured to exert a counter resistance for preventing the inner rods 150 (and therefore the swing-up storage assembly) from freely disengaging the outer rods 140, e.g., to thereby prevent the swing-up storage assembly 60 from causing damage or injury if a user inadvertently lets go of the swing-up storage assembly 60.

As illustrated in FIG. 5, openings 154 are formed through the distal ends of the inner rods 150 and are dimensioned to receive therethrough removable fasteners 151 (e.g., pins, shoulder screws, etc.) that are extended through the openings 96 of the receptacle support body 80, respectively. Preferably, the use of pins or shoulder screws enables the distal ends of the inner rods 150 to freely rotate with respect to the side walls 84 of the receptacle support body 80, respectively.

Referring to FIG. 6, openings 144 are also formed through the distal ends of the outer rods 140 and are dimensioned to receive therethrough removable fasteners 151 (e.g., pin, shoulder screws, etc.) that are extended through openings 43 formed in the side walls 40*a* of the freezer compartment 40, respectively. Preferably, the use of pins or shoulder screws enables the distal ends of the outer rods 140 to freely rotate with respect the side walls 40*a* of the freezer compartment 40, respectively. In the illustrated embodiment, grommets 160 are disposed in the respective openings 43 of each side wall 40*a* and are configured to receive the fasteners 151 therethrough, respectively, for securing the distal ends of the outer rods 140 to the freezer compartment 40. The grommets 160 embody a form of a wall anchor configured to pivotally support or suspend each side of the swing-up storage assembly 60 via the telescoping assemblies 130 connected to the respective sides of the receptacle support body 80. In such embodiments, the grommets 160 are partially extended into a space (not shown) between the outer case 19*a* (FIG. 3) and the respective side wall 40*a* of the freezer compartment 40 and secured in place via self-expanding foam that is injected into the space between the outer case 19*a* and the respective side wall 40*a*.

Referring to FIG. 6, a rail 42 is attached to each side wall 40*a* of the freezer compartment 40 and defines a track 42*a* that is configured to receive thereon the rollers 94 (FIG. 5) attached to the respective side of the receptacle support body 80. In this manner, each track 42*a* is configured to provide a reduced friction interface for a respective side of the receptacle support body 80 so that the receptacle support body 80 may be easily withdrawn from the freezer compartment 40. A front portion of each rail 42 may define an upwardly inclined ramp 42*b* to facilitate guiding the swing-up storage assembly 60 onto the rails 42 when returning the swing-up storage assembly 60 to the lower retracted position (FIG. 7), i.e., to help guide the insertion of the swing-up storage assembly 60 into the freezer compartment 40.

Figure 7:
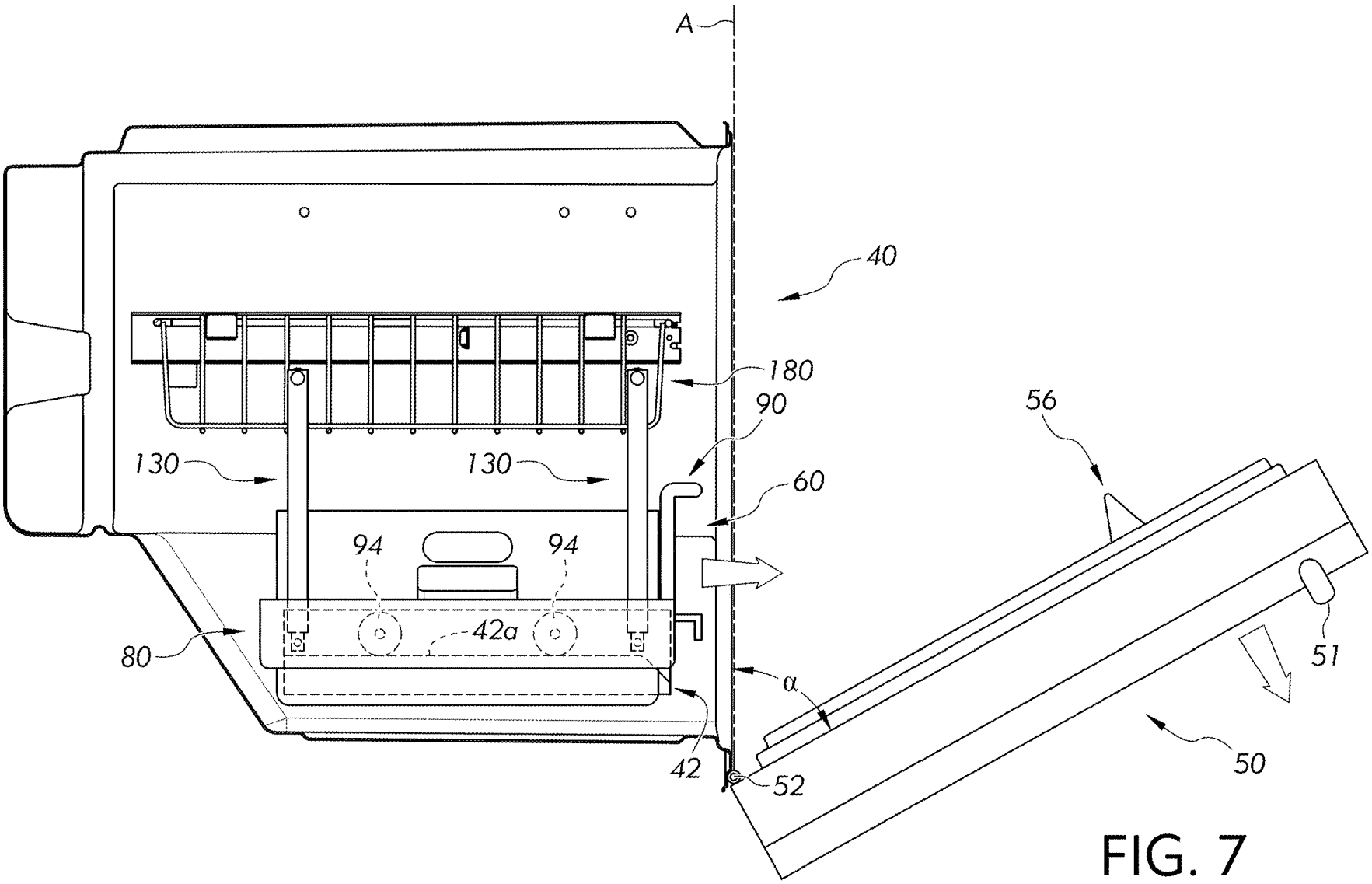
FIG. 7 is a side view of the freezer compartment taken in the direction of line 6-6 of FIG. 3 in a state wherein the swing-up storage assembly is in a lower retracted position.

Referring to FIG. 7, when the receptacle support body 80 is in the lower retracted position, the rails 42 also serve to vertically support the swing-up storage assembly 60, i.e., to transfer the load imposed by the weight of the swing-up storage assembly to the rails 42 of the storage compartment 40.

Figure 8:
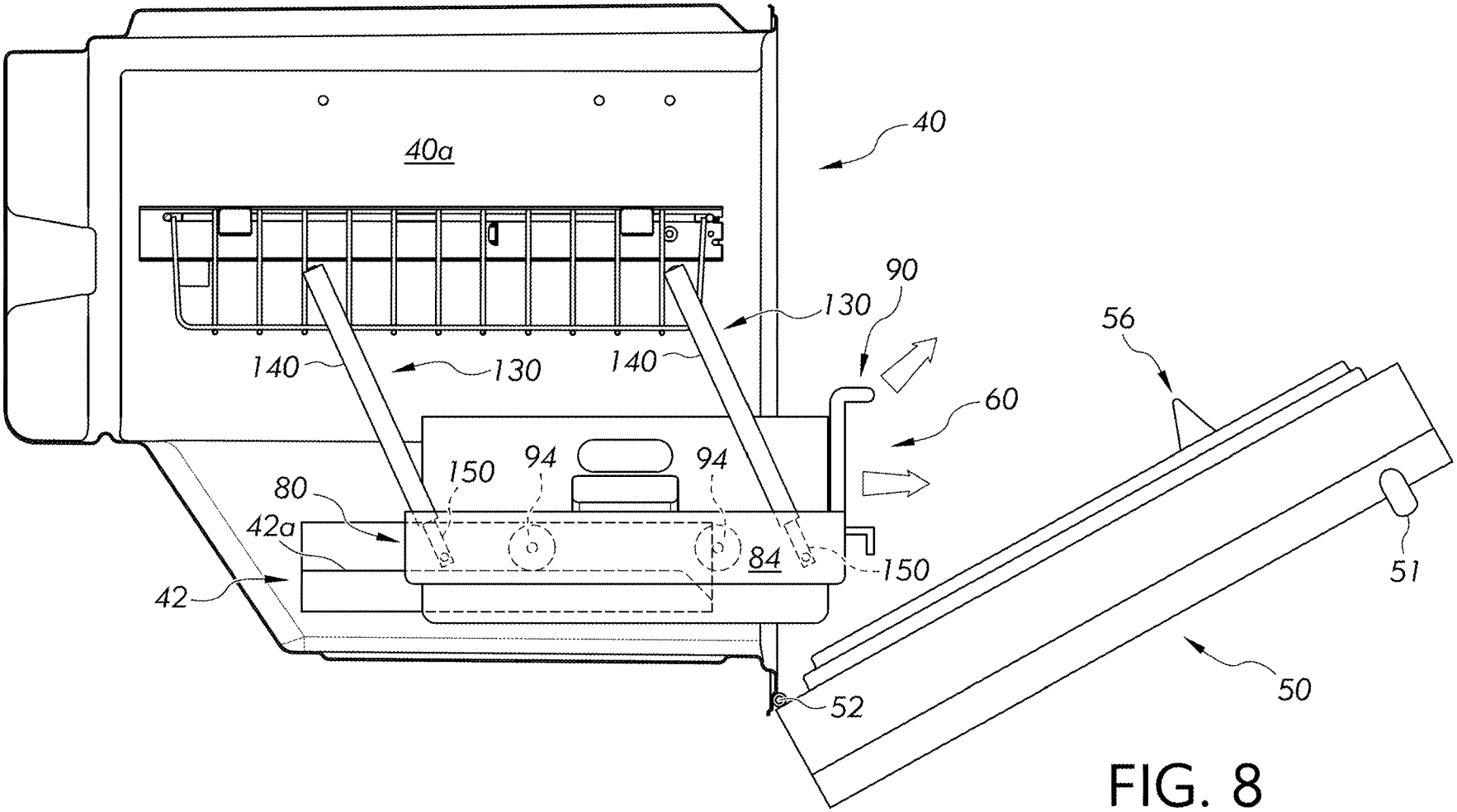
FIG. 8 is a side view of the freezer compartment taken in the direction of line 6-6 of FIG. 3 in a state wherein the swing-up storage assembly is in a partially extended position.

With reference to FIGS. 7-9, the swing-up storage assembly 60 will now be described with respect to one example operation. Referring to FIG. 7, when it is desired to access the swing-up storage assembly 60, a user may grasp the handle 51 of the freezer door 50 to pull the door 50 outwardly and downwardly such that the door 50 pivots upon the hinges 52. As noted above, it is contemplated that the hinges 52 may include a damper to prevent the door from rapidly swinging open due to the weight of the door, i.e., to control the rate at which the door is swung open. It is also contemplated that the hinges 52 may include a door stop (not shown) to control how far the door 50 may be swung open, e.g., to prevent the door 50 from rotating past a predetermined orientation or angle α relative to a vertical plane A corresponding to a front of the refrigerator appliance. In some embodiments, it is contemplated that the predetermined angle α is determined to ensure that the rack 180 may be fully extended without contacting the door 50, i.e., such that the door does not obstruct the rack 180 from being fully extended.

Referring to FIGS. 7 and 8, the swing-up storage assembly 60 may be moved from the lower retracted position to the upper extended position by pulling the receptacle support body 80 forward via the handle 90 thereof such that the rollers 94 thereof begin to roll on the tracks 42*a* defined by the rails 42. Referring to FIG. 8, as the swing-up storage assembly 60 is translated forward, the telescoping assemblies 130 will begin to pivot relative to the opposing side walls 40*a* of the freezer compartment 40, and with respect to the side walls 84 of the receptacle support body 80. At a certain point along the forward translational path of the receptacle support body 80, the inner rods 150 of the telescoping assemblies 130 will begin to telescopically extend out of the outer rods 140, thereby enabling the swing-up storage assembly 60 to continue to be withdrawn forwardly.

Referring to FIGS. 8 and 9, as the swing-up storage assembly 60 is withdrawn forwardly, a user may lift the swing-up storage assembly 60 via the upwardly protruding handle 90 formed on the receptacle support body 80 to thereby raise the swing-up storage assembly 60. During this time, the telescoping assemblies 130 will continue to pivot relative to the opposing side walls 40*a* of the freezer compartment 40 and relative to the opposing side walls 84 of the receptacle support body 80 to thereby enable the swing-up storage assembly 60 to swing upwardly. Utilizing telescoping assemblies 130 to pivotally connect the receptacle support body 80 to the freezer compartment 40 is particularly beneficial for enabling a user to withdraw and raise the swing-up storage assembly 60 along a trajectory that best fits the ergonomic needs of the user. For instance, some users may find it more comfortable to move the receptacle support body forward only partially 80 on the rails 42 until there is enough clearance to lift it upwardly to the upper extended position. Meanwhile, other users may prefer moving the receptacle support body 80 forward along an entire length of the rails 42 (e.g., to clear the rails) before lifting it upwardly.

Referring to FIG. 9, when the swing-up storage assembly 60 is raised to the upper extended position, a user may position the hooks 92 disposed on the front of the receptacle support body 80 onto the respective catches 56 disposed on the rear surface 50*b* of the door 50 to maintain the swing-up storage assembly 60 in the upper extended position. In some embodiments, it is contemplated that a sensor (not shown) may be disposed on the catches 56 to detect when the swing-up storage assembly 60 is in the upper extended position. In such embodiments, the sensor may communicate with a controller (not shown) that is configured to activate certain features, for example, compartment lighting or accent lighting.

In some embodiments, it is contemplated that a user may lift and remove the storage receptacle 100 from the receptacle support body 80 by inserting their hands into the openings 110 thereof to grasp and lift the storage receptacle 100, for example, when it is desired to clean the storage receptacle 100 or when it is desired to removably mount a different type of accessory item to the receptacle support body 80.

When it is desired to return the swing-up storage assembly 60 to the lower retracted position, a user may slightly lift the receptacle support body 80 upwardly via the handle 90 thereof such that the hooks 92 of the receptacle support body 80 disengage the catches 56 of the door 50. In this manner, the rear-facing rollers 94 (facing the storage compartment) affixed to the sides of receptacle support body 80 may be lowered onto the rails 42 such that the swing-up storage assembly 60 may be pushed into the freezer compartment 40 along the rails 42 thereof. It is contemplated that a user may guide the rollers 94 onto the rails 42 via the inclined ramps 42*b* formed on the respective front portions of the rails 42, respectively.

When a user disengages the hooks 92 of the receptacle support body 80 from the catches 56 of the door 50, it is contemplated that biasing members (not shown) may urge the inner rods 150 of the telescoping assemblies 130 into the outer rods 140 thereof to at least partially support the weight of the swing-up storage assembly 60, e.g., to prevent the swing-up storage assembly 60 from rapidly falling due to gravity. In this manner, the telescoping assemblies 130 may be adapted (e.g., spring-biased) to facilitate lowering the receptacle support body 80, e.g., to thereby induce the inner rods 150 to retract into the outer rods 140. In some embodiments it is contemplated that the inner rods 150 may be coupled to the outer rods 140 via tension springs for accomplishing this function. It is also contemplated that gas struts or another form of damper may be utilized to urge the inner rods 150 into the outer rods 140.

As the inner rods 150 are retracted into the outer rods 140, the distal ends of the inner rods 150 will pivot upon the opposing side walls 84 of the receptacle support body 80, and the distal ends of the outer rods 140 will pivot upon the opposing side walls 40*a* of the freezer compartment 40. When the rear-facing rollers 94 are positioned onto the tracks 42*a* of the rails 42, respectively, a user may guide the receptacle support body 80 into the freezer compartment 40 via the handle 90 thereof by pushing the swing-up storage assembly 60 into the freezer compartment 40 until it returns to the lower retracted position. In some embodiments, it is contemplated that rear stops (not shown) may be formed onto rear portions of the rails 42 to engage the rear rollers 94 to provide a tactile indication that the swing-up storage assembly 60 has returned to the lower retracted position.

Figure 10:
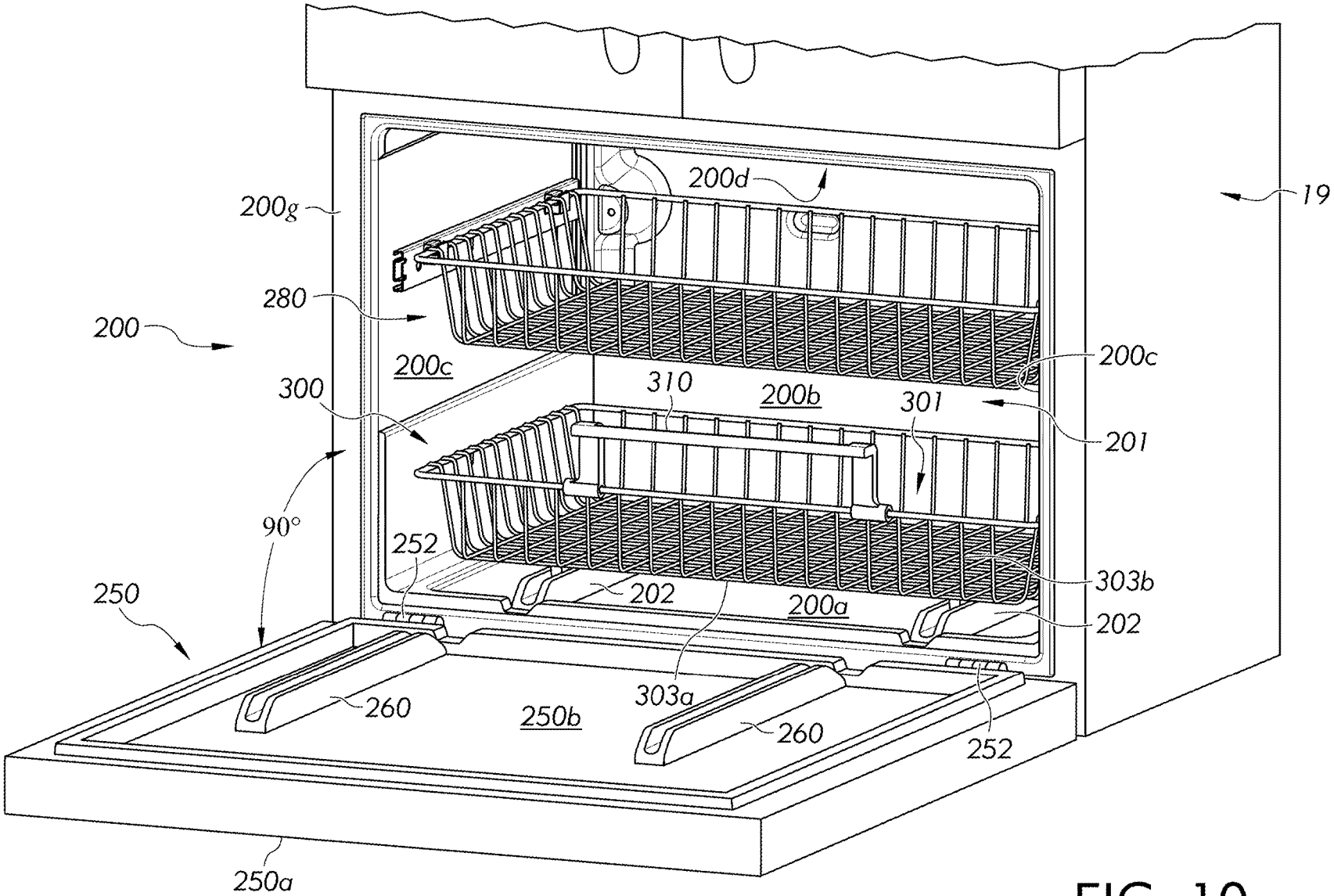
FIG. 10 is a partial, front perspective view of a freezer compartment according to another embodiment including a bottom-hinged freezer defining a pair of rails thereon.
Figure 11:
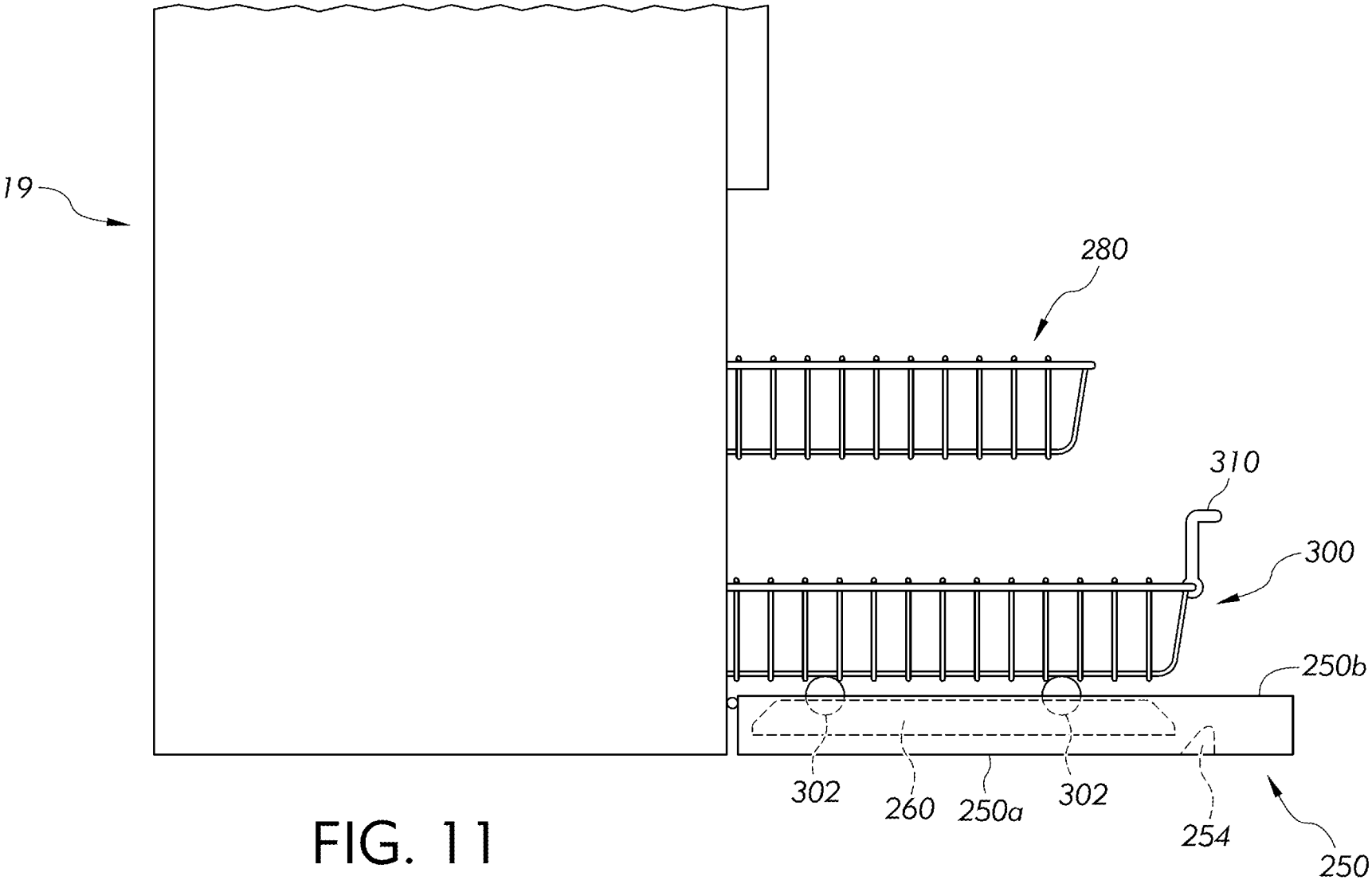
FIG. 11 is a side view of the freezer compartment of FIG. 10 in a state wherein an upper rack and a lower rack thereof are in an extended position.

Turning now to FIGS. 10-11, another example embodiment of a freezer compartment 200 for a bottom-mount refrigerator is shown with a bottom-hinged freezer door 250, an upper rack 280, and a lower rack 300. The freezer compartment 200, the upper rack 280, and the door 250 include substantially similar features as the freezer compartment 40, the rack 180, and the door 50 of the previous embodiment, respectively. Therefore, a detailed description therefor is omitted, except for the differences noted below. However, in this embodiment the swing-up storage assembly 60 may be omitted.

The storage compartment 200 includes a bottom wall 200*a*, a pair of opposing side walls 200*c*, a rear wall 200*b*, and a top wall 200*d* that collectively define a front access opening 201. A pair of longitudinally extending rails 202 are affixed to the bottom wall 200*a* and extend substantially between the front access opening 201 and the rear wall 200*b* of the storage compartment 200. In the illustrated embodiment, the rails 202 are partially hidden by the lower rack 300.

The rails 202 are shaped and dimensioned to cooperate with a pair of respective rollers 302 (FIG. 11) affixed to a bottom of the lower rack 300, as discussed in detail below. Similarly, the freezer door 250 defines a pair of rails 260 on a rear surface 250*b* thereof that are spaced apart and longitudinally aligned with the rails 202 of the bottom wall 200*a* of the storage compartment 200. In this manner, the door 250 defines a platform for extending the lower rack 300 forwardly onto a rear surface 250*b* thereof when the freezer door 250 is swung open by a user, e.g., 90° relative to a front vertical wall 200*g* of the freezer compartment 200.

The door 250 is pivotally coupled to a bottom portion of the cabinet 19 via a pair of hinges 252. It is contemplated that the hinges 252 may be spring-loaded to prevent the door 250 from rapidly opening and/or to maintain the door 250 in a sealing engagement with a front periphery of the cabinet 19. In addition, or alternatively, it is contemplated that a motor (not shown) may be actuated to open and close the door 250. As shown in FIG. 11, a front surface 250*a* of the door 250 may define a pocket handle 254 that is operable to open the door 250. Forming a pocket handle (as opposed to an outwardly protruding handle) may be particularly suitable to enable the door 250 to swing all the way open (90° relative to a front of the cabinet), e.g., such that the handle does not obstruct the door 250 from being fully opened. Alternatively, an outwardly protruding handle may be used and may further contact a floor surface underneath the door 250 to thereby support the door.

The lower rack 300 is a substantially rectangular shaped structure that defines a storage space 301 for food items. In the illustrated embodiment, the lower rack 300 embodies a wire basket, yet it should be appreciated that the lower rack 300 may take on other forms, for example, a storage accessory (e.g., an ice basket, a bin, an enclosed container) defined by a plurality of solid walls. As shown in FIG. 11, a pair of rollers 302 are affixed to a bottom wall 303*a* of the lower rack 300 and are configured to roll along the rails 202 of the storage compartment and along the rails 260 formed on a rear surface 250*b* of the freezer door. In this manner, the rollers 302 and the respective rails 202 and 260 of the freezer compartment 200 and the door 250 provide a reduced friction interface between the lower rack 300 and the freezer compartment 200, and between the lower rack 300 and the door 250 such that the lower rack 300 may easily be moved between a retracted state (FIG. 10) and an extended state (FIG. 11). While the illustrated embodiment depicts rollers 302 affixed to the bottom wall 303*a* of the lower rack 300, it is contemplated that in other embodiments the rollers 302 may be affixed to the side walls of the lower rack 300, for example, in such embodiments wherein the rails 202 of the storage compartment and the rails 260 of the freezer door are correspondingly spaced apart and aligned to accommodate the rollers 302 thereon. It is to be appreciated that the rails 260 of the door 250 may be used to fully support the weight of the lower rack 300, or alternatively, the lower rack 300 could be partially or even completely supported by a pair of extendable slides affixed to the side walls of the freezer compartment (i.e., similar to slides 45 previously described herein).

As shown in FIG. 10, an upwardly protruding handle 310 may be formed about a front wall 303*b* of the lower rack 300 and be operable move the lower rack 300 between the retracted and extended state. In some embodiments, it contemplated that an upwardly protruding handle may also be formed about a front wall of the upper rack 280.

Referring to FIG. 10, when the lower rack 300 is in the retracted state, it is supported by the bottom wall 200*a* of the freezer compartment 200 via the interaction between the rollers 302 (FIG. 11) and the rails 202 of the freezer compartment 200, or alternatively may be partially or completely supported by a pair of extendable slides, if present. On the other hand, and referring to FIG. 11, when the lower rack 300 is in the extended state, it is supported by the rear surface 250*b* of the freezer door 250 via the interaction between the rollers 302 thereof and the rails 260 of the freezer door 250.

In some embodiments, it is contemplated that the lower rack 300 may be extended forwardly and raised upwardly via an elevating mechanism, for example, via the spring loaded pivot arm arrangement disclosed in U.S. Pat. No. 10,729,306 which is incorporated by reference for all that it contains. In other embodiments, it is contemplated that the lower rack 300 may be raised upwardly via a motor (not shown).

The invention has been described with reference to the example embodiments described above. Modifications and alterations will occur to others upon a reading and understanding of this specification. Moreover, the swing-up storage assemblies and storage receptacles described herein may be adapted for placement in different refrigerator configurations (e.g., French-door, Top mount). Example embodiments incorporating one or more aspects of the invention are intended to include all such modifications and alterations insofar as they come within the scope of the appended claims and their equivalents.

What is claimed is:

1. A refrigerator appliance, comprising:

a cabinet defining a storage compartment therein, wherein the storage compartment comprises opposing side walls, a rear wall, a bottom wall, and a top wall that collectively define a front access opening;

a door hingedly connected to a lower portion of the cabinet and configured to open and close about a horizontal axis or pivot; and a freezer storage assembly including:

a receptacle support body pivotally and telescopically mounted to the side walls of the storage compartment, wherein the receptacle support body includes a handle protruding upwardly therefrom that is operable to move the receptacle support body between a lower retracted position and an upper extended position, and a receptacle removably mounted to the receptacle support body and defining a storage space for food items.

2. The refrigerator appliance of claim 1, wherein the receptacle support body further comprises a front wall, a rear wall, and opposing side walls that collectively define a receptacle opening, and wherein the receptacle is shaped and dimensioned to be at least partially extended into the receptacle opening.

3. The refrigerator appliance of claim 2, wherein the receptacle further comprises a pair of side walls, wherein each side wall includes a protrusion disposed thereon that is positioned to rest on a respective side wall of the receptacle support body to thereby removably mount the receptacle to the receptacle support body.

4. The refrigerator appliance of claim 1, wherein the receptacle support body further comprises opposing side walls each including a roller attached thereto, and wherein a rail is disposed on each side wall of the storage compartment and is configured to receive the respective roller of the receptacle support body to facilitate moving the receptacle support body between the lower retracted position and the upper extended position.

5. The refrigerator appliance of claim 4, wherein an inclined ramp is formed at a front portion of each rail and is configured to guide the insertion of the respective roller onto a corresponding rail.

6. The refrigerator appliance of claim 1, wherein the receptacle support body further comprises a front wall with a hook disposed thereon that is configured to engage a catch disposed on a rear surface of the door to thereby maintain the receptacle support body in the upper extended position.

7. The refrigerator appliance of claim 1, wherein the side walls of the storage compartment further comprise a first side wall and a second side wall, wherein the freezer storage assembly further comprises a first pair of telescoping assemblies and a second pair of telescoping assemblies, wherein the first pair of telescoping assemblies are configured to pivotally and telescopically connect a first side of the receptacle support body to the first side wall of the storage compartment, and wherein the second pair of telescoping assemblies are configured to pivotally and telescopically connect a second side of the receptacle support body to the second side wall of the storage compartment.

8. The refrigerator appliance of claim 7, wherein the refrigerator cabinet further comprises:

an outer case spaced apart from the storage compartment and defining a space therebetween, wherein the side walls of the storage compartment further comprise a first side wall and a second side wall, wherein the first side wall comprises a first pair of openings dimensioned to respectively receive therethrough a first pair of grommets that are extended into the space between the storage compartment and the outer case, wherein the second side wall comprises a second pair of openings dimensioned to respectively receive therethrough a second pair of grommets that are extended into the space between the storage compartment and the outer case, wherein the first pair of grommets and the second pair of grommets are secured in place via self-expanding foam injected into the space between the outer case and the storage compartment, and wherein the first pair of telescoping assemblies are pivotally connected to the first pair of grommets and the second pair of telescoping assemblies are pivotally connected to the second pair of grommets, respectively.

9. The refrigerator appliance of claim 1, wherein the receptacle further comprises an upwardly extending wall, and wherein a handle is formed about the upwardly extending wall and is operable to lift and remove the receptacle from the receptacle support body.

10. The refrigerator appliance of claim 1, wherein the refrigerator appliance further comprises a rack slidably supported by the storage compartment via a pair of extendable slides respectively affixed to the side walls of the storage compartment.

11. A swing-up storage assembly for a storage compartment of a refrigerator appliance, comprising:

a support body including a front wall, a rear wall, and opposing side walls that collectively define an internal space, wherein an upwardly protruding handle is formed about the front wall of the support body and is operable to move the support body between a lower retracted position and an upper extended position;

two pairs of telescoping assemblies, wherein each telescoping assembly includes a first end and a second end, wherein the first end is configured to pivotally connect to a respective side wall of the support body, and wherein the second end is configured to pivotally connect to a side wall of said storage compartment; and a removable storage accessory that is shaped and dimensioned to be removably mounted in the internal space of the support body.

12. The swing-up storage assembly of claim 11, wherein the removable storage accessory further comprises an upwardly extending wall, and wherein a handle is formed about the upwardly extending wall and is operable to remove the removable storage accessory from the support body.

13. The swing-up storage assembly of claim 11, wherein each side wall of the support body includes a roller attached thereto that is configured to roll on a respective rail disposed in the storage compartment to facilitate moving the support body between the lower retracted position and the upper extended position.

14. The swing-up storage assembly of claim 11, wherein the front wall of the support body further comprises a hook disposed thereon that is configured to engage a catch disposed on a rear surface of a storage compartment door to thereby maintain the support body in the upper extended position.

* * * * *